United States Patent [19]

Ullman

[11] Patent Number: 4,690,459

[45] Date of Patent: Sep. 1, 1987

[54] WORKING CHAIR

[76] Inventor: Johan Ullman, Ånestadsgatan 3, S-582 58 Linköping, Sweden

[21] Appl. No.: 788,640

[22] Filed: Oct. 17, 1985

[30] Foreign Application Priority Data

Oct. 19, 1984 [SE] Sweden ..... 8405225

[51] Int. Cl.[4] ..... A47C 3/00

[52] U.S. Cl. ..... 297/458; 297/423; 297/445

[58] Field of Search ..... 297/201, 423, 445, 452, 297/458

[56] References Cited

U.S. PATENT DOCUMENTS

| | | | |
|---|---|---|---|
| 3,669,493 | 6/1972 | Vowles | 297/423 X |
| 4,238,097 | 12/1980 | Clausen et al. | 297/423 X |
| 4,328,991 | 5/1982 | Mengshoel et al. | 297/423 X |
| 4,500,137 | 2/1985 | Morehouse | 297/458 |

FOREIGN PATENT DOCUMENTS

| | | | |
|---|---|---|---|
| 1115421 | 10/1961 | Fed. Rep. of Germany | 297/458 |

*Primary Examiner*—Kenneth J. Dorner
*Assistant Examiner*—Peter R. Brown

[57] ABSTRACT

Chair or stool comprising a seat (1) with a sitting surface and carried by a stand (7). The sitting surface is divided into two portions, a rear portion (2) intended to form a resting surface for the seat in the area of the ischium of a person, who is sitting on the seat, and a front portion (3), intended to form a resting surface for the under side of the thighs of said person. The rear portion is provided as a substantially horizontal main surface and with an effective length of substantially 10–15 cm utilized as a rest. The front portion is provided as a second main surface, which slopes forwards and downwards in an angle of substantially 16–30 degrees preferably 18–20 degrees and with a length from the edge of the rear portion (2) at the connection between the two said portions and to the outer edge of the front portion being substantially 23–30 cm.

4 Claims, 4 Drawing Figures

WORKING CHAIR

Figure 1:
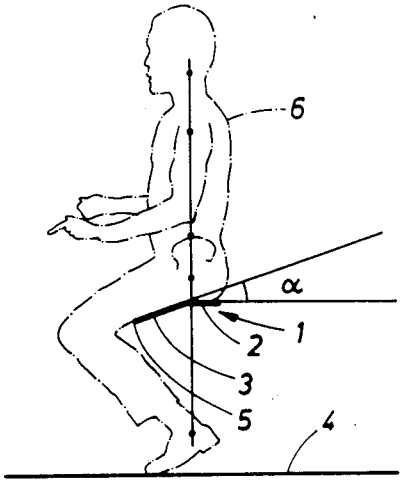

The present invention relates to a chair, preferably a working chair.

It is known that the sitting posture will result in physiological stresses in the human body, which can cause injuries. Especially this is the case when the posture is substantially unchanged for a long period of time as when working sequences are carried out in the sitting posture. There have been attempts to eliminate these disadvantages in the form of fatigue, pains and other inconveniences in the back, the neck and the shoulders, by designing chairs which are intended to give the best posture from the physiological point of view and thereby the least possible risk for inconveniences and injuries. In the conventional sitting posture on the chair, the seat and the upper part of the thighs rest against a horizontal or a slightly backwards leaning seat without the feet carrying any substantial weight. The back can rest against a support for the back and the most extensive attempts to obtain a functional working chair have been directed towards the design of this support for the back, its position and its mobility. It has not, however, been possible in this way to obtain a chair which complies with all demands raised.

Interest has therefore been directed towards another type of chair where the posture of the back is brought to be more similar that one has in the standing posture. The seat in this chair is not horizontal or backleaning but instead leans forwards so that the upper part of the thighs form an angle leaning downwards. By this arrangement the spine will be straightened compared to the form when sitting in the described, conventional type of chair and will be in substantially the same position as in the standing posture and will result in a corresponding lower stress of the disks. The head will have a position more direct in line with the spine and vertical over the pelvis, which is not the case in the conventional type of chair. In this respect the last mentioned chair is more advantageous and will limit the risk for wearyness and injuries. However, other difficulties present. A forwards leaning seat will give a tendency to slide forwards, which has to be neutralized either by support by means of the feet and the lower parts of the legs, which can cause fatigue, or instead special arrangements can be made such as knee supports, which can result in inconvenience in the form of swelling and stasis as a result of the pressure the knee supports will give and especially through the fixing of the position of the legs which arises.

The present invention has for its object to obtain a chair of the last mentioned type in which the two functions to give a downwards, forwards leaning position for the thighs and to form a secure sitting posture without disadvantages in the form of a tendency of sliding forwards are optimated, so that the result will be a sitting aid especially usable as a working chair.

Another object by the invention is to obtain a chair with said sitting posture, but without a fixed body posture but on the contrary so that the chair can be used for several types of sitting postures.

In the accompanying drawings

Figure 2:
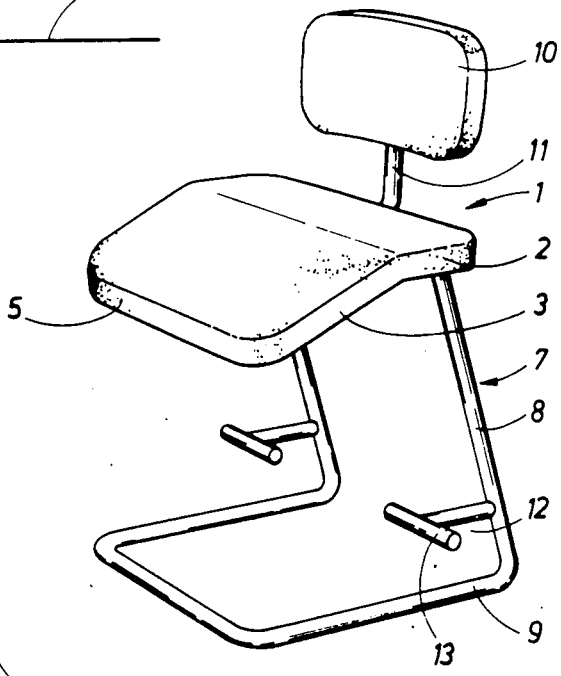
Figure 3:
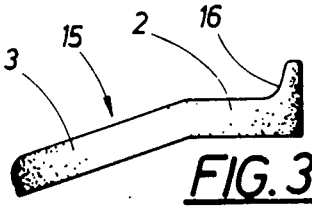
Figure 4:
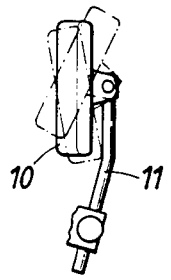

FIG. 1 shows a schematic figure in the form of a side view of the chair according to the invention;

in FIG. 2 is shown a perspective view of the chair in a preferred embodiment;

in FIG. 3 is shown a second embodiment of a seat for the chair;

and in FIG. 4 is shown a pivotable back support for the chair.

According to FIG. 1 the seat 1 of the chair shows on its upwards turned sitting surface a first portion, which will be referred to as the rear portion 2, and another portion, which will be referred to as the front portion 3. The seat 1 with the portions 2 and 3 is in FIG. 1 seen from the side. One can regard the schematic figure as an elevational view or a sectional view. It is evident that the surface of the portion 2 is horizontal and generally the chair consequently has to be adapted to obtain this horizontal position when it is standing on a horizontal foundation 4. The surface of the portion 3, the front portion, has an angle in relation to the surface of the rear portion 2 which is indicated as $\alpha$. This angle is preferably 16–30 degrees and 18 degrees has been shown as an especially suitable angle.

By the indication that the surface for the rear portion 2 has to be horizontal and that the surface for the front portion 3 shall lean forwards with an angle of 16–30 degrees, this has a bearing on the indicated viewing direction, which is relevant for FIG. 1. This, however, does not mean that the surfaces for the portions 2, 3 have to be planes in the side direction of the chair, consequently in different sections parallel to the plane of the paper but displaced in relation to each other. The seat can namely be in the shape of a curve or a bowl with a middle raised portion and upwards bowed outer side portions with intermediate lower portions. Thereby the said direction of the sitting surfaces especially has bearing on the lower portions onto which the load from the seat and the thighs of the sitting person substantially is supported.

The measure of length for the surfaces of the portions 2, 3 has to be adapted to the person or the persons who will use the chair. Normally it is possible to indicate a measure of 10–15 cm for the effective length of the rear portion 2, consequently the length of the surface, which is used as a support for sitting; the importance of how long the portion extends rearwards will be discussed later. The length of the front portion 3 ought to be 23–30 cm in the normal case. This is the length from the end of the portion 3 at the portion 2 and the front edge 5 of the portion 3, which may not extend so far that it will reach the hollow behind the knee of the person 6, which is using the chair. Suitably the length is adapted, so that support is reached for $\frac{2}{3}$ of the length of the thigh.

In FIG. 2 a perspective view of the chair or stool is shown in an embodiment. The seat 1 with its portions 2 and 3 and the front edge of the portion 3 are evident from the figure. The sitting surfaces on the portions 2 and 3 are shown somewhat bowled shaped in a bow which will result in somewhat raised edges. The seat 1 is carried by a stand 7, which here is shown as a tube stand with two uprights 8 and a lower bow 9 which is intended to rest against the foundation.

In the sitting posture which is obtained, the support for the back can dispensed with. However, such a support can fulfill the function to fix the sitting person in correct position in relation to the portions 2 and 3 so that the position will not be too far backwards. Further the support for the back can be advantageous if one momentarily desires to change the sitting posture from the upright posture according to FIG. 1 to a back leaning position. For this purpose the support for the back can be pivotable backwards either against the pressure of a spring or after releasing of a catch. In FIG. 2 is shown a support 10 for the back adjustable in its height over the seat and of the sway back support type, which support is carried by an upright 11, which is stretching from the stand 7.

In the embodiment according to FIG. 3 there is shown a seat which is indicated as 15. It shows the earlier mentioned portions 2 and 3, which are arranged in the angle positions mentioned before. Also this seat is intended to be supported by a stand, which however is not shown. The difference in the seat 15 in relation to the seat 1 is that its rear edge, consequently the edge of the rear portion 2, is terminated by means of a raised portion 16. The rear portion 2 has thereby to be adapted regarding its length, so that the before mentioned measure is included between the edge at the continuation into the front portion 3, and the raised portion 16.

The raised portion 16 will give a correct position on the seat on condition that the end of the back is placed against the same. It is consequently not necessary to rely on a support for the back to obtain a correct position and the portion 16 rising directly from the seat will also give a more exact position than a support for the back placed over the seat. As one in practice has no need for a support for the back according to the type of sitting posture, which the chair is intended for, the support can be omitted. Alternatively a type of support for the back, which will give the possibility of an alternative posture, for example a backleaning posture, may be arranged, while at the specific sitting posture, which is possible with the chair, any support for the back will not be used as a support for the body.

Another function, which the raised portion 16 can be arranged for is as a support for the pelvis to try to urge it in a forward pivoted position (anti-clockwise in FIG. 1), so that a concave bowing of the loin, a lordosis and not convex bowing, kyphosis is obtained. Per se the sitting posture obtained by means of the surfaces of the portions 2 and 3 of the seat gives rise to a tendency to the forming of a lordos, which however further can be promoted by means of said raised portion. For this purpose it is however necessary that it has a certain height in the magnitude of a 5–10 cm, while if only determination of the position is the purpose, the height can be less, even less than 5 cm. In the last said case the raised rear portion can merely be given the form of a termination of a bowl shape rather than a real, specific raised portion.

According to FIG. 1 the sitting person 6 will obtain a forward leaning position of the thighs when they rest against the front portion 3. The lower parts of the legs have, for obtaining the intended position and the reduced load at the spine, to be pivoted in acute angle or at least not in a marked obtuse angle to the thighs as is shown in FIG. 1. The feet can rest against the foundation 4. By the said angle of 16–30 degrees for $\alpha$ and a suitable rear pivoting of the lower parts of the legs, a person of a normal stature obtains a sitting height which is adapted to a conventional height of a working table (about 75 cm). The chair can however be provided with special resting supports for the feet according to what is shown in FIG. 2. Here are shown foot rests 12 with outwards extending pins 13. The intention is that the pins 13 will be used for resting of the heel of the shoe or the arch of the foot. If the pins are positioned slightly over the height, which is necessary to let the feet rest against the pins without pressure against the foundation, it is possible to change position by letting the feet rest against the pins or against the foundation. Such a possibility to change position is favourable for the comfort.

In the sitting posture, which is natural to take at said position in the chair and which is shown in FIG. 1, the pelvis is unloaded from loads tending to turn it backwards (clockwise in FIG. 1) by means of the muscles on the backside of the thighs. An unloading of these muscles is especially noticable by the shown position with the lower parts of the legs pivoted back in under the seat. By sitting on a horizontal or backwards leaning surface on the other hand and especially when one has the under legs pivoted forwards a stress is the result, which tends to turn the pelvis in a direction which will make it difficult to keep a lordusis by the muscles stresses present.

In the posture shown in FIG. 1, which is natural to take, the advantageous load aimed for is obtained. Consequently the load of the disks will be low and about the same as in the standing posture partly through a lower bending load directed towards the spine and instead a bending load, which is suitable to take up by the inwards bowed small of the back and partly by a substantially elimination of the torque from body parts loading the back. Such loads are the result of body parts working with their weight at a distance from the carrying structures. As evident from FIG. 1 it obtained that at the said sitting posture the head with the atlas vertebra, the shoulder joint, the central portion of the hip bone and the hip joint will be placed substantially on one and the same vertical (indicated by means of dots in FIG. 1). Further the ankle is placed in the same vertical. Hereby the torque will be minimized. Thereby a low disk pressure is obtained and a lower muscle tonus. Examinations have shown that the stress on the disks in the standing posture will be 3–4 times lower than by sitting in an upright position on a conventional chair. With the chair according to the invention the disk load will be similar to the one in the standing posture. With the chair according to the invention a considerable decrease of harmful loads on the back is obtained. This has also bearing on muscle stresses with reference to the back-, neck- and shoulder musculature.

As mentioned the sitting surfaces on the portions 2 and 3 can be given a somewhat varied design. According to the design in general the seat ought to be relatively firm but somewhat resilient by means of firm but still resilient material e.g. hard cellular plastic which will give a distribution of the surface pressure and a certain adaption to different body shapes. The surfaces may however not be so soft that a deformation will arise so that deviation from the general shape will be the result. The texture has to be somewhat rough, not too smooth and not slippery. The shape of the seat will give some forwards directed powers, which means that a smooth surface is not suitable. These loads are however so low that they can be counteracted by means of a somewhat rough surface such as will be obtained by textiles and also by a not entirely elastomeric material.

The foregoing specification has for its main part been directed towards the specific sitting posture, which is shown in FIG. 1 and which cannot be obtained by means of a conventional chair. Even if this sitting posture, as has been shown, is advantageous and in reality seems to be the most advantageous posture when one has to perform a work, there will be in all works, where a sitting posture is used such as typewriting, breaks by which it is advantageous if one can change sitting posture. An object with the chair according to the invention as mentioned in the preamble is that, in spite of its resulting in said advantageous working posture, it will not fix the body in this posture but will make varying sitting postures possible. Accordingly one has by the indicated leaning of the seat possibilities to sit e.g. leaning forwards and also to take other postures which one is used to take on a conventional chair. Thereby one has suitably the lower parts of the legs directed forwards. As mentioned the chair can be constructed with a normal sitting height and it is accordingly possible to have the legs directed forwards without having them freely hanging. The support for the back of the chair, if the same is provided with such a support, can be adapted for different sitting postures; also the back leaning posture at the occasions when one desires to change the sitting posture temporarily. It has thereby been mentioned the alternatives of a locked or resilient support for the back with adjustment according to the back leaning posture or a back leaning support for the back, which is not used in the mentioned specific sitting posture. Further it has to be mentioned that the seat per se can be adjusted so that one temporarily will have a chair with a substantially horizontal or backwards leaning seat.

As has been evident from the foregoing the most important characteristics of the chair are related to the shape of the sitting surface. This shape can be combined with many different embodiments for other parts such as the stand of the chair, its support against the foundation, foot rests present, support for the back and also arm rests and shapes for making stacking possible and so on. A suitable shape of the chair for office use can be a stand with a central upright and a carrying part with for example five arms and wheels and also a spring support for the back. A possibility for adjusting the height of the seat and the position of the support for the back has to be provided for as is usual in conventional chairs of this type. On the other hand the leaning of the seat must not be adjustable, in the sitting posture described, at least not outside a limited area for example + or 5 degrees. If the possiblity to adjust will be such that the front portion 3 can be adjusted to horizontal or back leaning position the idea behind the chair is lost.

An important feature in the chair is the fixation of the sitting person with the thighs leaning downwards and forwards as described while the carrying parts of the pelvis, the ischium in the sitting position are positioned on the horisontal surface. Consequently in spite of the thighs being placed on a sloping surface there will be no or a very low tendency of the body to slide forwards as the weight of the same is substantially carried by a horizontal surface. In order to obtain this the position of the body has to be very exact, so that either the carrying parts of the pelvis will be placed on the sloping surface or the edge between the sloping and the horizontal surfaces will press against the thighs. In order to reach this exact position either a support for the back or the raised rear portion 16 can be used as described. Most advantageous, is to use a raise portion as this will give an exact position while the position fixed by means of a support for the back to some extent will be less exact. The raised rear portion can be adjustable to different body measures and, as said before, can also be provided with an upper edge pressing the pelvis to turn forwards (anti-clockwise in FIG. 1) preventing the spine from a convex posture, kyphosis.

That the chair has to show said characteristics and consequently is not possible to change outside these characteristics by adjusting, has bearing to sitting in the extensive described specific sitting posture. As mentioned the chair can be adjustable also for other sitting postures, which preferably will be taken temporarily. Such as adjustment is however not in any way necessary to utilize the determined advantages of the chair. If the chair is adjustable for different sitting postures it may be provided so that there is a determined, defined position of adjustment for the specific sitting posture and with reference to this position what is mentioned about the determined angles is relevant. On the other hand there can be free adjustment possibilities with reference to the height position for adjustment to different body sizes.

I claim:

1. A chair comprising:

a stand having two uprights and a lower bow connected thereto for resting against a foundation, a foot rest provided on said uprights, said foot rest having outwardly extending pins and being positioned slightly above the height which is necessary to allow a person's feet rest against the pins without pressure against the foundation;

a seat carried by said stand having an upwardly facing sitting surface provided with a resilient material giving a distribution of surface pressure, a textured surface covering provided on said sitting surface, said seat having on its upwardly facing sitting surface a rear portion and a front portion;

said rear portion being a substantially horizontal main surface having an effective length of substantially 10–15 cm;

said front portion being a second main surface which slopes forwards and downwards at an angle of substantially 16°–30° and preferably 18° with relation to the surface of the rear portion, said front portion having a length from the edge of the rear portion at a connection between said two portions to an outer edge of the front portion of substantially 23–30 cm, and being suitably adapted so that support is provided for $\frac{2}{3}$ of the length of a person's thigh; and a support for a person's back carried by said stand.

2. A chair according to claim 1, wherein said rear portion at its end remote from said connection between the said two portions terminates in a raised portion having a sufficient height and an upper supporting edge to press against the pelvis of the person sitting on the chair in order to turn the same forwards, thereby urging the spine of the person to form a lordosis.

3. A chair according to claim 1, wherein said stand is a tube stand, said resilient material of said sitting surface is hard cellular plastic, said raised edge has a height of the magnitude of 5–10 cm, and said support is a pivotable support which is adjustable in height over said sitting surface.

4. A chair according to claim 1, wherein said support for a person's back is pivotable to support a person in a plurality of postures.

* * * * *